US009080806B2

(12) United States Patent
Vanelli et al.

(10) Patent No.: US 9,080,806 B2
(45) Date of Patent: Jul. 14, 2015

(54) ADJUSTABLE SHELF TO BE ACCOMODATED IN FREEZER COMPARTMENT TO IMPROVE COOLING PROCESS SPEED

(75) Inventors: Matteo Vanelli, Comerio (IT); Uday Mathur, Comerio (IT); Andrea Olivani, Comerio (IT); Tiemen T. Van Dillen, Moosburg (AT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/117,682

(22) PCT Filed: Mar. 29, 2012

(86) PCT No.: PCT/EP2012/055729

§ 371 (c)(1), (2), (4) Date: Jan. 9, 2014

(87) PCT Pub. No.: WO2012/156142

PCT Pub. Date: Nov. 22, 2012

(65) Prior Publication Data

US 2014/0152158 A1 Jun. 5, 2014

(30) Foreign Application Priority Data

May 16, 2011 (EP) ..... 11166170

(51) Int. Cl.

*F25D 17/00* (2006.01)
*F25D 17/06* (2006.01)
*F25D 17/04* (2006.01)

(52) U.S. Cl.

CPC ..... *F25D 17/06* (2013.01); *F25D 17/04* (2013.01); *F25D 17/045* (2013.01); *F25D 17/062* (2013.01); *F25D 2317/061* (2013.01); *F25D 2317/063* (2013.01); *F25D 2400/30* (2013.01)

(58) Field of Classification Search

CPC ..... F25D 17/06; F25D 17/062; F25D 17/065; F25D 17/045; F25D 2317/061
USPC ..... 312/404, 406, 407; 62/408, 382, 187
See application file for complete search history.

(56) References Cited

U.S. PATENT DOCUMENTS

| | | | | |
|---|---|---|---|---|
| 4,009,590 | A * | 3/1977 | Webb et al. | 62/180 |
| 5,437,503 | A | 8/1995 | Baker et al. | |
| 7,665,320 | B2 * | 2/2010 | Scrivener et al. | 62/187 |
| 7,891,205 | B2 * | 2/2011 | Cushman | 62/152 |

FOREIGN PATENT DOCUMENTS

| | | | |
|---|---|---|---|
| FR | 2788844 | A1 | 7/2000 |
| JP | 61011581 | A | 1/1986 |
| JP | 2005321154 | A | 11/2005 |

OTHER PUBLICATIONS

European Patent Application No. 11166170.8 filed May 16, 2011, Applicant: Whirlpool Corporation. European Publication No. 2525174A1, dated Nov. 21, 2012 and Search Report re: Same.
International Patent Application No. PCT/EP2012055729 filed Mar. 29, 2012, Applicant: Whirlpool Corporation. International Publication No. WO2012156142A2 dated Nov. 22, 2012 with Search Report re: Same.

* cited by examiner

*Primary Examiner* — Daniel Rohrhoff

(57) ABSTRACT

A refrigerator with a fast freeze compartment is disclosed. The refrigerator comprises a no frost freezer compartment and a fresh food compartment. The refrigerator has a fast freeze compartment disposed within the fresh food compartment in which a food item can be placed, wherein the fast freeze compartment comprises an adjustable baffle adapted to change the cross section area of the air passage. The refrigerator further has a fan configured to propel cold air toward the fast freeze compartment, wherein the fast freeze compartment has a rear wall provided with at least one fan and a front swinging door, the adjustable baffle being located between side walls.

12 Claims, 2 Drawing Sheets

ADJUSTABLE SHELF TO BE ACCOMODATED IN FREEZER COMPARTMENT TO IMPROVE COOLING PROCESS SPEED

This application is a National Phase entry of International Application No. PCT/EP2012/055729 filed 29 Mar. 2012, which claims priority to European Application No. 11166170.8 filed 16 May 2011.

BACKGROUND

The present invention relates to a fast freezing system comprising a fan for blowing cold air toward a compartment in which a food item is placed. The present invention relates as well to a refrigeration appliance, particularly a no frost freezer, where the above fast freezing system is installed.

Fast freezing or quick freezing is well known in the art of refrigerators, and it is a process in which cold air downstream an evaporator (usually a finned one) if somehow forced by a fan to flow around a food to be frozen.

A large number of known quick freezer/shock freezer systems have an entire compartment dedicated to perform multiple food preservation processes such as shock freeze. Given the fact that today a large number of people buy frozen meats from the super markets, that are about 3 cm thick and about 8-12 cm in length, and the current systems available on the market that are between 10-20 liters of volume, there is a lot of wasted open space that needs to be cooled prior to cool the food items. Due to the larger size of the compartment and the smaller size of the food item (typically meat), the time to shock freeze any food item may be unduly long, creating also problem of good conservation (it is well known that the shorter is the freezing time, the longer will be the time in which the frozen food can be stored in the freezer. While this freezing time increases, the system in itself is not very efficient and there is a lot of wasted energy as well.

SUMMARY OF THE PRESENT DISCLOSURE

An object of the present invention is to provide a fast freezing system of the type mentioned above which does not present the above drawbacks, and which is simply and not expensive to be produced in series.

Such object is reached thanks to the features listed in the appended claims.

One of the main advantages of a fast freezing system according to the present invention is the decrease of the overall time required to cool down the food by roughly 10-30%. In order to get this advantage the cross section area of the air flow can be adjusted according to the food item dimension, therefore increasing the air speed (and therefore increasing the heat exchange coefficient and reducing the freezing time) when small food items have to be frozen. According to a first embodiment of the invention, a shelf-shaped baffle is used, such shelf having predetermined high and low settings. When the shelf is in its high position, the compartment is at its maximum volume thus increasing the time to cool down/shock freeze the food items. When the customer desires he/she can flip the shelf and thereby reduce the cooling time of the system.

According to a second embodiment, a telescopic shelf is used. Such telescopic shelf would allow the customer to easily change the overall volume or space of the compartment where the cold air is flowing. This shelf is flexible and can be adjusted based on customer preference. When it is in the closed (retracted) position, the overall volume of the compartment is at its maximum. When the shelf is in its complete open position (extended), due to its predetermined slope the overall volume of the compartment is reduced, thus improving the cooling performance and reducing the time to freeze for the food items.

An adjustable shelf would help to improve the cooling performance of the system, by reducing the overall volume/space of the compartment and increasing the speed of cooling by 10-20%. The customer would have the choice to keep the constant volume of the compartment or to decrease the volume to eventually speed up the cooling process of the food items. This would significantly reduce the time to cool food down as well as make the system a lot more efficient.

Further advantages and features of a fast freezing system according to the present invention will become clear from the following detailed description, with reference to the annexed drawings.

DETAILED DESCRIPTION OF THE EMBODIMENTS

Figure 1:
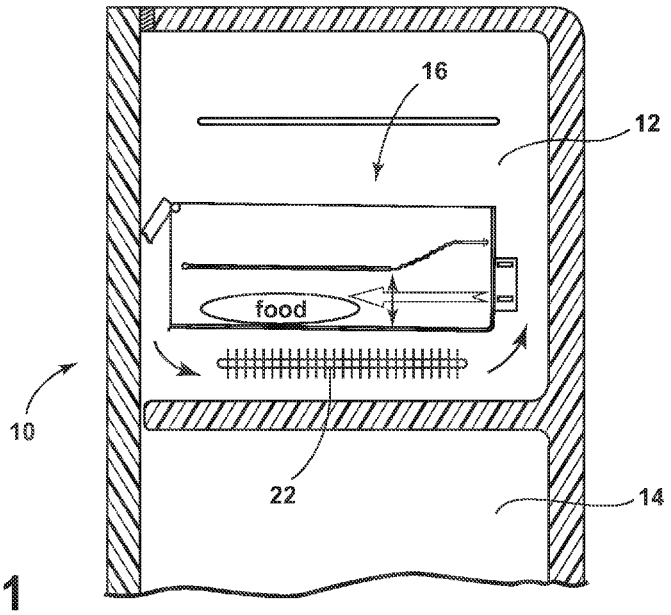
FIG. 1 is a cross section view of a refrigeration appliance provided with the fast freezing system according to the present invention.

With reference to the drawings, with 10 is indicated a refrigeration appliance having a no frost freezer 12 and a fresh food compartment 14. In the freezer compartment 12 it is placed a sub-compartment 16 defined by a bottom wall 16*a*, a rear wall 16*b* and two side walls 16*c*. On the front opening of the sub-compartment 16 it is hinged a swinging door 18 allowing a front access to the sub-compartment. On the rear wall 16*b* there are two fans 20 which are blowing an air flow towards the inside of the sub-compartment 16. Upstream the fans 20, in the direction of the air flow as indicated in FIG. 1, it is placed a finned evaporator 22.

Figure 2:
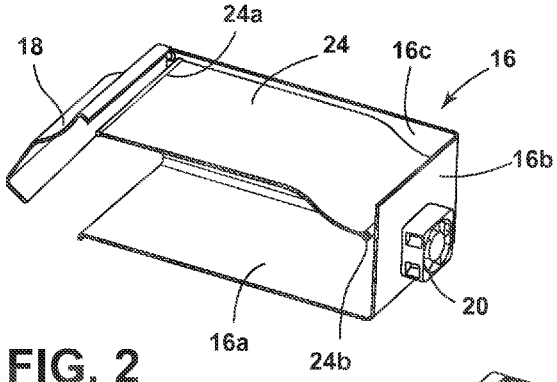
FIG. 2 is a perspective partially sectioned view of the fast freezing system shown in FIG. 1, according to a first configuration.
Figure 3:
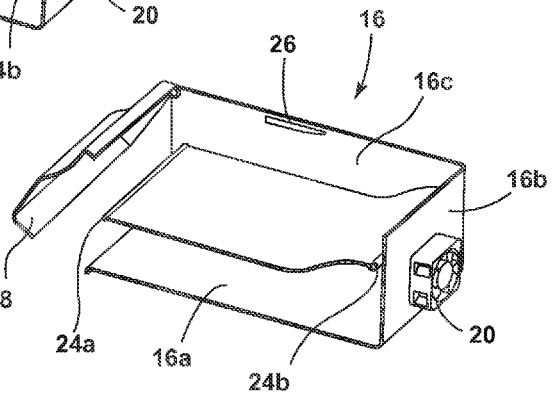
FIG. 3 is similar to FIG. 2 and show a second configuration of the fast freezing system according to the invention.

As a top wall of the sub-compartment 16 it is used a flexible baffle 24, for instance of rubber or similar material, which is fixed at its ends to a front rod 24*a* and to a rear rod 24*b*. The rear rod 24*a* is fastened in a fixed position above the fans 20, while the front rod 24*a* is movable in at least two different positions shown in FIGS. 2 and 3. In the configuration shown in FIG. 2 (up position) the flexible baffle 24 define a maximum volume in the sub-compartment 16 for big items of food to be fast frozen. In this configuration the cross section area of the air passage increases from a position adjacent the fans (20) to a position far from the fans (20). In the configuration shown in FIGS. 1 and 3, the front rod 24*a* of the flexible baffle 24 is fastened in a lower position so that the volume is reduced, as well the cross section area for the air flow. In this configuration the cross section area of the air passage decreases from a position near the fans (20) to a position far from the fans (20). In this way the air speed in the sub-compartment 16 around the food item is increased, therefore reducing the time for fast freezing. For maintaining the flexible baffle 24 in the correct positions, the side walls 16*c* are each provided with rails 26 (FIG. 3) on which the edge portions of the baffles 24 can rest.

Figure 4:
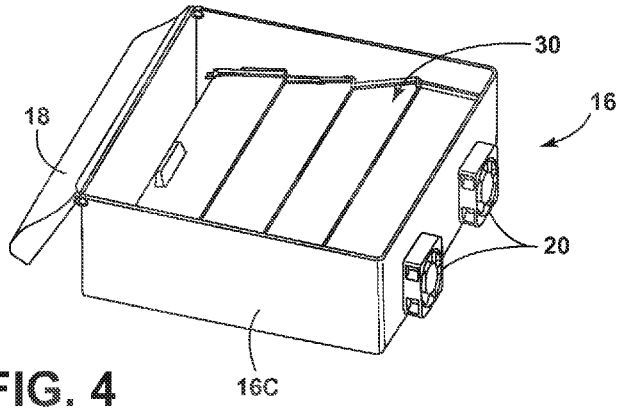
FIG. 4 is a perspective view of a fast freezing system according to a second embodiment of the invention and in a first configuration.
Figure 5:
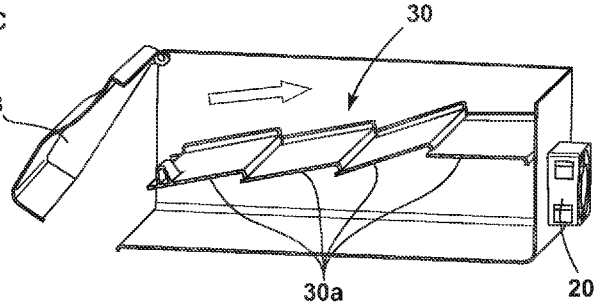
FIG. 5 is a perspective and partially sectioned view of the fast freezing system of FIG. 4.
Figure 6:
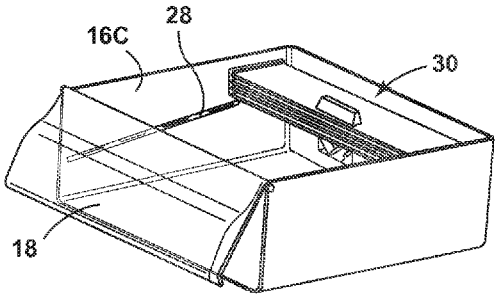
FIG. 6 is a perspective view which shows the fast freezing system of FIG. 4 in a second configuration.
Figure 7:
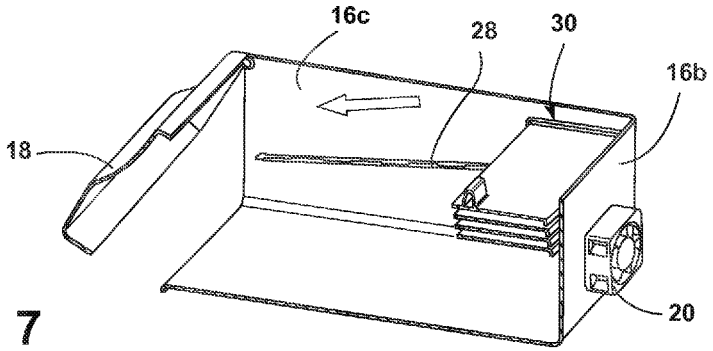
FIG. 7 is perspective partially sectioned view of the fast freezing system of FIG. 6.

In the embodiment shown in FIGS. 4 to 7 (where similar components have been indicated with the same reference numerals), the sub-compartment 16 present, on its side walls 16*c*, two slanted rails 28 on which the edges of a telescopic baffle 30 can slide. In FIGS. 4 and 5 the telescopic baffle 30 is in its extended position, corresponding to the configuration shown in FIGS. 1 and 3 of the first embodiments, in which a maximum speed of the air flow inside the sub-compartment may be obtained. In FIGS. 6 and 7 the telescopic baffle is shown in its retracted position in which the different pieces 30*a* of the baffle 30 are stacked one above the other.

It is clear that the adjustable baffle can be realized in different ways, for instance by using a flexible baffle which can be rolled on roll adjacent the fans, or by using a sort of shutter having a plurality of pieces which can be extended or folded, and that those shown in the drawings are given only as examples.

It is also clear that with the adjustable baffle according to the invention it is possible to modify the shape of the compartment used for fast freezing in order to give to the customer the flexibility to drive the cold air flow in a better way towards the food, improving the freezing process.

What is claimed:

1. A fast freezing system comprising:

a compartment in which a food item can be placed; and a fan configured to propel cold air toward the compartment, wherein the compartment comprises an adjustable baffle adapted to change the cross section area of an air passage, and wherein the adjustable baffle is an extendable telescopic wall adapted to slide on inclined guides in the compartment and adapted to assume a stacked configuration adjacent the fan and an extended configuration which defines an air passage of decreasing cross section area.

2. The fast freezing system according to claim 1, wherein the compartment comprises a rear wall provided with at least one fan and a front swinging door, the adjustable baffle being interposed between side walls.

3. The fast freezing system according to claim 1, wherein the guides are disposed on side walls of the compartment so that the height of such guides is lower in the front area of the compartment than in the rear area thereof.

4. The fast freezing system according to claim 1, wherein the adjustable baffle is fixed to a front and rear rod mounted transversally in the compartment, the front rod being adjustable in different predetermined positions.

5. The fast freezing system according to claim 1, wherein the guides are disposed on side walls of the compartment so that the height of such guides is lower in the front area of the compartment than in the rear area thereof.

6. A fast freezing system comprising:

a compartment in which a food item can be placed; and a fan configured to propel cold air toward the compartment, wherein the compartment comprises an adjustable baffle adapted to change the cross section area of an air passage, wherein the adjustable baffle is made of flexible material adapted to assume a first configuration in which the cross section area of the air passage increases from a position adjacent to the fan to a position far from the fan and a second configuration in which the cross section area of the air passage decreases from a position adjacent the fan to a position far from the fan, and wherein the adjustable baffle is fixed to a front and rear rod mounted transversally in the compartment, the front rod being adjustable in different predetermined positions.

7. A refrigerator comprising:

a fast freezing system, the fast freezing system comprising:

a compartment in which a food item can be placed;

a fan configured to propel cold air toward the compartment, wherein the compartment comprises an adjustable baffle adapted to change the cross section area of an air passage, and wherein the adjustable baffle is an extendable telescopic wall adapted to slide on inclined guides in the compartment and adapted to assume a stacked configuration adjacent the fan and an extended configuration which defines an air passage of decreasing cross section area.

8. The refrigerator according to claim 7, wherein the compartment comprises a rear wall provided with at least one fan and a front swinging door, the adjustable baffle being interposed between side walls.

9. The fast freezing system according to claim 8, wherein the adjustable baffle is fixed to a front and rear rod mounted transversally in the compartment, the front rod being adjustable in different predetermined positions.

10. The fast freezing system according to claim 8, wherein the guides are disposed on side walls of the compartment so that the height of such guides is lower in the front area of the compartment than in the rear area thereof.

11. The fast freezing system according to claim 7, wherein the guides are disposed on side walls of the compartment so that the height of such guides is lower in the front area of the compartment than in the rear area thereof.

12. A fast freezing system comprising:

a fast freezing system, the fast freezing system comprising:

a compartment in which a food item can be placed;

a fan configured to propel cold air toward the compartment, wherein the compartment comprises an adjustable baffle adapted to change the cross section area of an air passage, wherein the adjustable baffle is made of flexible material adapted to assume a first configuration in which the cross section area of the air passage increases from a position adjacent to the fan to a position far from the fan and a second configuration in which the cross section area of the air passage decreases from a position adjacent the fan to a position far from the fan, and wherein the adjustable baffle is fixed to a front and rear rod mounted transversally in the compartment, the front rod being adjustable in different predetermined positions.

* * * * *